United States Patent [19]

Sato

[11] 4,253,476

[45] Mar. 3, 1981

[54] TOBACCO FILTER AND METHOD OF REMOVING IMPURITIES FROM TOBACCO SMOKE

[76] Inventor: Shigeo Sato, 4-4-3 Higashi-Kanesawacho, Hitachishi, Ibarakiken, Japan

[21] Appl. No.: 929,233

[22] Filed: Jul. 31, 1978

Related U.S. Application Data

[63] Continuation-in-part of Ser. No. 782,021, Mar. 28, 1977, abandoned, which is a continuation of Ser. No. 556,877, Mar. 10, 1975, abandoned.

[30] Foreign Application Priority Data

Mar. 8, 1974 [JP] Japan ..... 49-27376

[51] Int. Cl.[3] ..... A24D 3/04

[52] U.S. Cl. ..... 131/261 B; 131/263; 131/264; 131/10.7; 131/11; 131/10 A

[58] Field of Search ..... 131/10 R, 10 A, 10.3, 131/10.5, 10.7, 10.9, 198 R, 198 A, 200–204, 216, 210, 261 R, 261 B, 264, 265, 263

[56] References Cited

U.S. PATENT DOCUMENTS

| | | | |
|---|---|---|---|
| 2,819,720 | 1/1958 | Burbig | 131/10 A |
| 3,172,410 | 3/1965 | Miller | 131/198 R |
| 3,240,213 | 3/1966 | Miller | 131/10.9 |
| 3,270,750 | 9/1966 | Campbell | 131/10.3 |
| 3,336,928 | 8/1967 | Morehouse | 131/10.5 |
| 3,602,232 | 8/1971 | Grauvogel | 131/10.5 X |

FOREIGN PATENT DOCUMENTS

| | | | |
|---|---|---|---|
| 431169 | 2/1968 | Switzerland | 131/10.5 |

*Primary Examiner*—V. Millin

*Attorney, Agent, or Firm*—Toren, McGeady and Stanger

[57] ABSTRACT

A tobacco filter having a hollow cylindrical body which is preferably transparent, is provided with a plurality of small holes in its outer wall, and with a solid impermeable hit-stick coaxially positioned within the hollow body. A porous annular-shaped filter element surrounds the axial mid-part of the hit-stick. Impurities in tobacco smoke are removed by a process of hit-sticking extraction in the form of numerous black dots on the surface of the hit-stick as well as the result of automatic, rapid self-liquefication of the filter element. At one end of the hollow cylindrical body a filter tip is positioned to be held in the mouth of the smoker, and at the other end is a cigarette holding part for receiving and holding a conventional cigarette. The hit-sticking extraction results from air jets being drawn into an annularly shaped passageway located between the outer surface of the hit-stick and the inside surface of the hollow cylindrical body and through which smoke flows axially as the smoker draws on the filter.

37 Claims, 22 Drawing Figures

TOBACCO FILTER AND METHOD OF REMOVING IMPURITIES FROM TOBACCO SMOKE

CROSS REFERENCE

This is a Continuation-in-Part of co-pending application Ser. No. 782,021 filed on Mar. 28, 1977 now abandoned, which in turn is a Continuation of Ser. No. 556,877 filed Mar. 10, 1975, now abandoned.

BACKGROUND OF THE INVENTION

The present invention relates to a filter for tobacco smoke which can extract harmful substances from the smoke and can almost instantaneously cool down the temperature of the tobacco smoke so that it will become more tasteful to the smoker.

Various types of pipes or cigarette holders are presently in use to filter out harmful substances contained in the tobacco smoke, such as tars, nicotine, 3-4 Benzpyrene and the like. Almost all of the known holders and filters, however, have many shortcomings such as the following: insufficient filtering action, high costs, being too heavy, incapable of sufficiently cooling the smoke, very bothersome and annoying to clean, very difficult to draw smoke therethrough, become clogged with tars, messy and causing tobacco stains, having an unpleasant taste, loss of effectiveness and inability to render tobacco smoke safe and tasteful through the ends of a cigarette, easily destroyed and, in certain filters, water is needed such as with aqueous filters.

Prior art filter devices have been made utilizing interior chambers and a plurality of holes on the outside of the body of the filter. However, such prior art filters have been incapable of accomplishing the impurity extraction effect afforded by the present invention in that such prior filters have failed to recognize and take advantage of "hit-sticking extraction", "air jet cooling", and "automatic rapid liquefication of an intermediate filter".

Accordingly, it is a principal object of the present invention to provide both a filter for tobacco smoke and a method of extracting impurities from gaseous substances generally and from tobacco smoke specifically which filter and method overcomes all of the disadvantages of the prior art.

It is a further and more specific object of the present invention to provide a filter which is disposable, very inexpensive and very effective for extracting impurities from tobacco smoke, particularly for extracting the impurity 3-4 Benzpyrene.

Another specific object of the present invention is to provide such a tobacco smoke filter taking advantage of the recognition of the foregoing principles found to be useful in extracting impurities from tobacco smoke.

Still another object of the present invention is to provide a tobacco smoke filter containing an intermediate annular shaped filter element which is relatively narrow and relatively short permitting all the smoke to be drawn therethrough and which is more effective than conventional cigarette tip filters.

The above objects, features and advantages, and along with other objects, features and advantages of the present invention will become more apparent from the detailed description of the invention, in conjunction with the accompanying drawings to be described more fully hereinafter.

SUMMARY OF THE INVENTION

The foregoing and other objects of the present invention are generally accomplished by providing a filter for tobacco smoke having a hollow body portion with a porous filter tip coaxially carried at one end of the body portion which is intended to be held in the mouth of the user, and a cigarette holding part coaxially connected at the other end of the body portion for receiving and holding a cigarette. A solid impermeable hit-stick is coaxially positioned within the body portion and has an axial length substantially the same as the axial length of the body portion. Thus an annular-shaped or ring-like passage is formed between the inner wall surface of the body portion and the outer surface of the hit-stick through which smoke from a cigarette held in the cigarette holding part passes. A porous intermediate filter having a configuration substantially the same as the ring-like or annular passage is positioned at approximately the mid-axial point of the hit-stick and is tightly secured thereabout completely filling the passageway. A plurality of holes which form nozzles are located in the wall of the hollow body portion extending into its interior on both sides of the intermediate filter. Air can be drawn through the holes into the annular chamber as a result of a smoker's suction on the filter.

In this manner the principles of air jet cooling and hit-sticking extraction are practiced along with the principle of automatic self-liquefication of the intermediate filter for effectively and completely eliminating the undesirable impurities in tobacco smoke.

In practice, when a lit cigarette is held in the cigarette holding part of the filter of the present invention and a smoker draws or sucks on the filter tip end of the filter, cool outside air flows through the plurality of holes in the body portion producing air jets in the annular-shaped passageway and causing the smoke to hit against the impermeable surface of the hit-stick. As a result, the various impurities are extracted by hitting against the hit-stick and are retained as numerous black dots on the surface of the hit-stick.

This is accomplished by optimizing the diameters of the holes to between about 0.01 mm and 0.5 mm for effectively generating the violent air jets necessary to practice the principle of air jet cooling and hitting extraction.

Also, it is necessary to optimize the number of holes for effective quantitative elimination of the impurities in the range of between 10 and 200 such holes.

Further, the distances between the holes must be optimized to approximately 0.1 mm–5 mm.

Moreover, the clearance between the hit-stick and the inside surface of the hollow body part portion should be optimized to approximately 0.1 to 2.0 mm, and finally the surface condition of the hit-stick should also be optimized and preferably made of wood and/or paper clad materials having surface conditions of optimum hardness and ruggedness comparable to those of wood or tightly rolled paper and/or surface treated metals or plastics for optimum hit-sticking black dot extraction.

DESCRIPTION OF THE INVENTION

Figure 1:
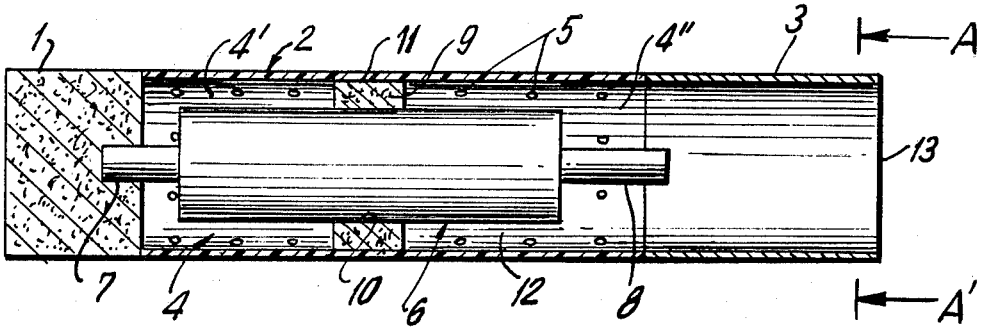
FIG. 1 is a sectional view taken axially through the filter of the present invention.

As shown in FIG. 1, the invention includes a cylindrical porous filter tip 1 which is inserted into the smoker's mouth. The diameter of the filter tip 1 is approximately 7–10 mm and is usually about 8 mm, but may be larger. The length of the tip 1 is approximately in the range of 3–30 mm and is usually approximately 5 mm, but may be longer. A hollow cylindrical body portion 2 is directly and coaxially connected with the tip 1. The outer diameter of the hollow cylindrical body portion 2 is approximately the same as that of the tip 1, i.e., approximately 7–10 mm and usually approximately 8 mm. The length of the hollow cylindrical body portion is in the range of 6–60 mm. The hollow cylindrical body portion can be made of transparent, semi-transparent or opaque material, which is also humidity-absorbing and/or an anti-humidity (waterproof) material, and, for example, it can be made of cellophane. The tip 1 and the hollow cylindrical body portion 2 combine to form an interior chamber 4. A plurality of holes 5 are formed through the wall of the hollow cylindrical body portion 2 and extend either perpendicularly to or chordally of the longitudinal axis of the body portion 2. In practice there are usually more than two holes provided in the wall but in some cases there may be only one, and in a special case there are no holes. The diameters of the holes 5 are usually equal and relatively small, for instance on the order of 0.01–0.3 mm, or possibly greater. The holes 5 are distributed about the hollow cylindrical wall with adequate distances between them, such as approximately 1 mm.

Figure 3:
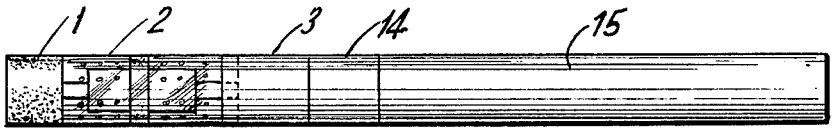
FIG. 3 is a side view of the filter of the present invention showing a cigarette inserted into a body portion which is made of transparent material.

A cigarette holding part 3 of hollow cylindrical shape is coaxially connected to the end of the body portion 2 remote from the filter tip 1. The inside diameter of the cigarette holding part 3 is desirably the same as the outside diameter of the tip 14 of a conventionally made cigarette 15 (see FIG. 3). The length of the cigarette holding part 3 is approximately in the range of 4–60 mm. Preferably, the cigarette holding part 3 is made of paper having some resilience and usually with a thickness of about 0.0001–0.5 mm for providing a very inexpensive and yet satisfactorily strong cigarette holding part which is reusable or disposable at will, and for other reasons. A cigarette entrance 13 is at the open end of the cigarette holding part 3, so that a cigarette can be easily inserted (such as by screwing in) through the entrance 13 into the holding part 3.

Solid impermeable cylindrical hit-stick 6 is axially arranged within the body portion 2 and has an axial length in the range of approximately 3–60 mm, and is approximately the same length as the hollow cylindrical body portion 2. The diameter of the hit-stick 6, however, is less than the inside diameter of the hollow cylindrical body portion 2, for example 6 mm, while the inside diameter of the hollow cylindrical body part is approximately 8 mm. The hit-stick 6 is coaxially arranged within the interior chamber 4.

A support projection 7 projects from one end of the hit-stick 6 and is firmly attached to the central portion of the filter tip 1 thus serving to assist in keeping the hit-stick 6 in the coaxial position within the hollow cylindrical body portion 2 in the interior chamber 4. The stopper 8 also projects from the other end of the hit-stick 6 and acts as a stop against the end of the cigarette tip 14 of the cigarette 15 inserted in the cigarette holding part 3. The length of both the support projection 7 and the stopper 8 has been found to be adequate if it is in the range of approximately 8–6 mm, or possibly more. The diameter of both the projection 7 and the stopper 8 is significantly smaller than the diameter of the hit-stick 6.

Figure 2:
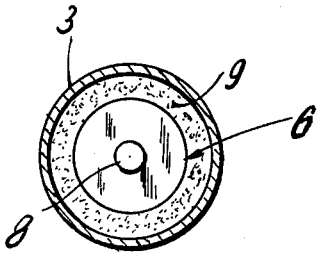
FIG. 2 is a cross-sectional view taken along the line of A—A' in FIG. 1.

A ring-like passage 12 for the flow of tobacco smoke is formed between the inside wall surface of the hollow cylindrical body portion 2 and the outside cylindrical surface of the hit-stick 6. A porous intermediate filter 9, such as shown in cross-section in FIG. 2, and in axial section, plan view and perspective view, respectively, in FIGS. 12*a*, 12*b* and 12*c*, and having exactly the same ring shape as that of passage 12, is inserted into and positioned within the passage 12 at approximately the axial mid-part of the hit-stick 6. The porous intermediate filter 9 fills the entire ring-shaped cross-sectional area of the passage 12 with its inner wall 10 tightly surrounding the surface of the cylindrical hit-stick 6, and with its outer wall 11 also tightly urged against the cylindrical inside wall surface of the hollow cylindrical body portion 2. The intermediate filter 9 has an axial length approximately in the range of 0.1–10 mm and preferably in the range of 1–3 mm, and serves to separate the interior chamber 4 into two parts 4' and 4'', part 4' being positioned between the filter tip 1 and the intermediate filter 9 and the other part 4'' being positioned between the intermediate filter 9 and the cigarette holding part 3. Accordingly, tobacco smoke must pass at least once through the intermediate filter 9. Although only one intermediate filter 9 is shown herein, a number of such filters may be axially positioned along the hit-stick 6 and in special cases they may be arranged in twos, threes or more, adequately separated from each other along the length of the hit-stick 6.

Figure 7:
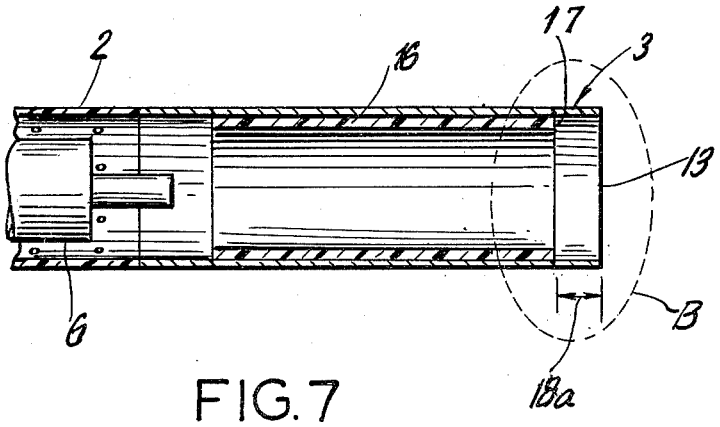
FIG. 7 is a partial sectional view showing a further embodiment of the cigarette holding part of the filter of the present invention.
Figure 8:
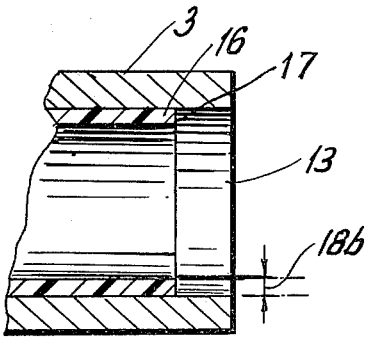
FIG. 8 is an enlarged sectional view showing the encircled area "B" of FIG. 7.

Referring now to FIGS. 7 and 8, a further embodiment and an improved cigarette holding part 3 is provided having a thin inner layer 16 over the inside wall surface of the holding part. A displaced end 17 extends inwardly from the cigarette entrance 13 forming a displacement 18*a* of an axial length in the range of 0.1 to 10 mm, and preferably in the range of 1–3 mm. Sometimes, the displacement 18*a* is 0-mm long.

The thin layer 16 is preferably made of such materials as a thin, soft and elastic paper or synthetic resin coating, such as thin vinyl film. In the improved embodiment of the cigarette holding part 3, as shown in FIGS. 7 and 8, the inside diameter of the thin layer 16 is preferably the same as the outside diameter of a conventional cigarette tip.

This embodiment of the cigarette holding part 3 enables easier insertion of the cigarette into the holding part, since it has a small degree of clearance 18 at the displaced end 17, such as shown in the enlarged view of FIG. 8. Preferably, cigarette holding part 3 is made out of relatively thick and strong paper of some resiliency or a similar material, the inner layer 16 is made of materials which may be much thinner, very soft, and yet very elastic, such as paper, vinyl film, and the like. Hence this bi-material combination and its resulting small degree of clearance enables easier insertion of a cigarette into the improved cigarette holding part 3 through the cigarette entrance 13.

This improved two-material structure (resilient-elastic combination with displaced end) also produces a desirable sealing effect, i.e., an air-tight tobacco or cigarette holding effect because of the high degree of elasticity of the thin layer 16. If a vinyl film is used for the thin layer the entire cigarette holding part 3 becomes antihumid, i.e., waterproof. This is particularly important because of the high water vapor content typically found in tobacco smoke. Also, such materials as vinyl film or silicone-resin coating for layer 16 results in an inner surface which is very smooth and slippery and is thus very convenient for the insertion of a cigarette into the cigarette holding part 3. Further, the use of a thin paper for the cigarette holding part 3, which is reusable, durable, unexpectedly strong, and disposable at any time, is indeed a surprising new development in the use of such papers. These papers for the cigarette holding part 3 are very inexpensive, very low in weight, practically without volume, easy to make waterproof, simple to handle for transportation, machining and the like. It is notable that such soft, thin, fragile paper has such remarkable characteristics. By using these papers it is possible for the filters of the present invention to be uniquely styled, compact, extremely light and durable and unexpectedly strong. The style of the reusable filter of the present invention of the same shape as a cigarette with its enchanting transparent (see-through-look-style) is very unique. Cigarette becomes as if elongated itself. (See FIGS. 1 and 3). This stylish cigarette self-elongation effect with its transparent feeling adds beauty and elegance as well as dignity to a smoker's smoking action that could be further accentuated with a help of some good pictures and/or design printings upon the holding part 3 and attracts people's eyes strongly. All these possible by the use of papers and/or thin plastics for the body portions. The filter tip 1 and also holding part 3 could be made transparent.

Further, the filters because of the papers used, are excellently reusable and disposable and particularly low in cost. These features and qualities of the filter of the present invention resulting from the use of papers for the cigarette holding part 3 are among the most important characteristics of the present invention.

Papers used for holding part 3 are of the same weight of 25–250 g/m$^2$, e.g., printing-, writing-, decoration- and wrapping papers etc., and synthesized paper as from nylon, vinylon, rayon, polystyrene and polypropylene etc., e.g., styrene papers and fluoro carbon resin paper etc., also thermoplastic resin with or without plasticizer with DOP. For example polyvinylidene chloride, nylon, polyethylene, polystyrene, polypropylene, polycarbonate etc. And for the inner layer 16, the papers of the weight of 0–75 g/m$^2$ of the same sort and the plastics as mentioned above for the holding part 3 can be used. For the hollow cylndrical body portion 2, also the materials used for the holding part 3 and the inner layer 16 can be used. For the hit-stick 6 any kinds of wood of a woody-rough surface can be used, e.g., pine, oak, cedar, apple tree, cherry tree, redwood, Japanese cypress (sun tree), bamboo, magnolia tree, ginkgo, willow, walnut beech, pomegranate, lemon tree, a sweet osmanthus and fern etc. and synthesized wood from pulp wood as veneer wood etc. Plastics such as used for paper holding part 3 can be used as well as thermosetting resins, e.g., phenol resin, Xylene resin, Urea resin, silicone resin, epoxy resin, melamine resin, etc. Any metals can be used for the hit-stick 6 such as copper, iron, tin, zinc, aluminum etc. with adequate surface treatment. Any kind of porous materials can be used for intermediate ring filter 9, such as cotton, wool, silk, natural fibers, synthetic fibers, textiles, flax and sponges etc., even a fine meshed metal wire filter will do.

For mouth tip 1, the same materials as for ring filter 9 can be used. Also a charcoal filter. Sometimes this mouth tip 1 has no porous filter but only an adequate support construction for the support projection 7.

As a result of the foregoing described structure of the present invention, the tobacco filter performs a number of functions.

One such function may be described as the "Air Jet Cooling and Hitting Extraction Effect". This effect and function can be appreciated from the following description. Ambient or cool outside air flows into the body portion 2 as violet jets through the holes 5 into the ring-shaped passage 12 as a result of a smoker's suction on the end of the filter. Because the diameter dimensions of the holes 5 are in the range stated above, all of the in-flowing cool outside air passing through the holes into the tobacco smoke passing through the passage 12, form violent jets. The hit-stick 6 is positioned in the hollow cylindrical body portion 2 in a way that is most suitable for the above-described air jets to traverse the tobacco smoke passing through the ring-shaped passage 12 and strike the smoke directly against the hit-stick in an effective and powerful manner.

In the embodiment shown in FIG. 1, the hit-stick 6 is shown in the shape of solid cylindrical body while its housing has the shape of a hollow cylinder. The hit-stick 6, however, may have other shapes and the hollow body portion may have complementary shapes to form differently configured passageways. For example, the hit-stick may be a triangular body resulting in a triangular passage, or it may become a rectangular body resulting in a rectangular passage.

As a result of the incoming cool outside air action described above, the following phenomenon occurs. The air jet engages the tobacco smoke which is passing through the passage 12 and causes the smoke to hit directly onto the solid surface of the hit-stick 6, while simultaneously cooling the smoke temperature which occurs quite effectively such as instantaneously, by direct gas molecular heat exchange. Also, at the same time, the jet causes component substances of the smoke (such as tars, nicotine, 3-4 Benzpyrene, water vapor, etc.) to be extracted as black dots which adhere to the surface of the solid hit-stick 6.

Figure 10:
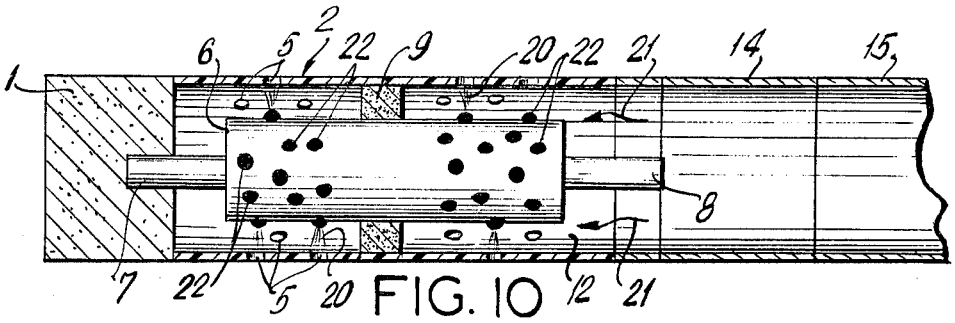
FIG. 10 is an axial sectional view of the filter embodying the present invention and illustrating the manner in which harmful substances are extracted from cigarette smoke.
Figure 11:
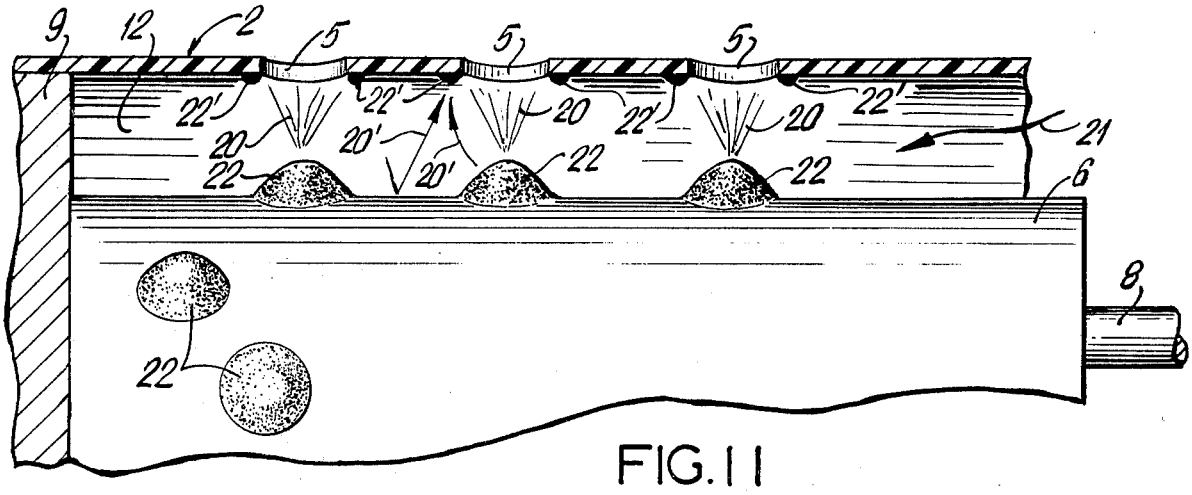
FIG. 11 is an enlarged sectional view of a portion of FIG. 10 further illustrating the manner in which harmful substances are extracted as "black dots" from the cigarette.

This phenomenon is schematically shown in FIGS. 10 and 11 which illustrate the effect of the air jets 20 entering the holes 5 and encountering the smoke, indicated by arrows 21, passing through the ring-shaped chamber 12 and causing the impurities to be extracted as black dots 22 on the surface of the hit-stick 6. The enlarged view in FIG. 11, shows the extracted impurities as black dots 22 on the surface of the hit-stick as well as reflected impurities 22' formed about the peripheries of the holes 5 on the inside surface of the cylindrical body portion 2 like a small black ring. The number of holes is important; the greater the number of holes the greater the black dots, hence increased extraction of impurities. This number could be in the range of 1 to 1000 or more.

As noted in FIG. 11, the air jets 20 are violent jets as a result of the optimum chosen diameter of the holes 5, preferably in the range of about 0.01 mm to 0.50 mm. Also, the number of holes is optimized to between about 10–200 in relation to a suction strength. The jets engage the flow of smoke 21 passing through the passage 12, which also has a chosen optimum ring-shaped dimension the thickness of which is preferably in the range of 0.1 mm to 2.0 mm, and cause it to hit directly on the surface of the hit-stick 6, the material of which is also chosen for optimum results. Smooth-surfaced plastics or metals are used for the hit-stick 6 and are recommended to undergo a surface treatment of some ruggedness, mechanically or chemically. As noted above, the extracted impurities are collected as black dots 22 on the hit-stick surface; and also collect as small black rings 22' around the inner periphery of the holes 5 as a result of the reflection of the air jets indicated by arrows 20'. The reflection-extraction 22' is a bit one-sided or eccentric from the center of the holes 5 appearing as a small black dot upon the surface of the inside wall of the body portion 2 when the center-axis of holes 5 extends at an oblique angle to the surface of the hit-stick 6. This deflection extraction, the small black ring 22' though small in quantity, increases significantly with the number of holes employed. Other reasons for this deflection-extraction may be, extra cooling at the periphery of the holes, and/or the formation of a stationary annular vortex, a doughnut-ring-like vortex around the column of an air jet at the periphery of the holes which is hydrodynamically observed.

This phenomenon of hitting extraction has a double effect. First, hitting the smoke against the solid surface and second, the simultaneous cooling effect on the temperature of the smoke. The smoke hitting effect alone can cause component substances in the tobacco smoke to stick to the hit-stick 6. Cooling additionally makes some of the smoke component substances reach their dew point helping them to extract instantaneously and stick far easier onto the solid surface of the hit-stick 6. The point is, the mean temperature in the passage 12 could remain much higher than a dew-point temperature of some impurities extracted, the impurities won't evaporate easily if only they are once extracted as black dots upon the surface of the hit-stick 6. As previously noted, this phenomenon is referred to as "Air Jet Cooling and Hitting Extraction Effect". The result of the air jets through the multiple holes 5 is also sometimes referred to hereinafter as "air shower".

Another function of the present invention is referred to as "Automatic Rapid Liquefied Filter Formation". This function will be better understood from the following description. The porous intermediate filter 9 of the present invention is similar in material to other conventionally made cigarette porous filter tips typically made from cotton fiber etc., but is different as will be described hereinafter in the following sub-paragraphs "a", "b", "c" and "d".

a. The intermediate filter 9 is constructed in a manner so that its smoke passage cross-sectional area is smaller than that of conventional cigarette filter tip, due its ring shape. In a conventional cigarette filter tip having a diameter of approximately 8 mm, its cross-sectional area is 16 $\pi$ sq. mm. If, however, the inside diameter of the hollow cylindrical body portion 2 is 8 mm and the hit-stick 6 has a diameter of 6 mm and is arranged in the interior chamber 4 coaxially with the hollow cylindrical body portion 2, then its ring cross-sectional area is $(4^2-3^2)=7\ \pi\ ^2$mm, which is less than half the area of the conventional cigarette filter tip.

Accordingly, when "y" amount of cigarette smoke passes through both the conventional filter and the filter of the present invention in a given period of time t, then the amount of smoke which passes through a unit cross-sectional area in a unit period of time is $y/7\ \pi\ t$ for the intermediate filter 9 of the present invention; and $y/16\ \pi\ t$ for the conventional cigarette tip, almost more than double the density of the smoke for the intermediate filter 9 than that for the conventional filter tip. In this manner the tars, nicotine, 3-4 Benzpyrene, water vapor (turned water) which is originally contained in a vast amount in the cigarette smoke will be trapped at least twice as much or more in the intermediate filter 9 in a unit period of time and in a unit volume.

b. The intermediate filter 9 has an axial length of approximately 2 mm, thus it is shorter than conventional cigarette tips of about 15–20 mm. The volume of the intermediate filter 9, having a cross-sectional area of $7\ \pi^2$ mm and an axial length of 2 mm will then be 1/17 of that of a conventional cigarette tip. The point is "The foremost-Cut Advantage". (1) The shorter filter always catches the impurities at highest contents (at the foremost place, see FIG. 4). (2) Hence much of the axial length of a filter can be changed away without sacrificing much of its capability. The component substances in cigarette smoke trapped in the filter (mostly in the liquid state) tend to diffuse more uniformly throughout the filter. At that stage of diffusion, if linear trapping is assumed lengthwise of the filter, the mean level of density of diffused substances (liquid) remains higher for the intermediate filter 9 than that for conventional cigarette filter tips, because of its smaller axial length as will be apparent from FIG. 4.

c. Outside cool air jets are induced by the smoker's suction into the passage 12 through holes 5 into chamber part 4''. This cool air at a temperature of about 10° mixes itself violently with the cigarette smoke at a temperature around 900° C. If one unit amount of cool air is admitted into the chamber part 4'' for one unit amount of flowing smoke, then assuming specific heat is the same for both air and smoke, the mean temperature of the air-smoke mixture becomes about 450° C. instantaneously by virtue of violent gas molecular heat exchange, thus enabling some of the tars, nicotine, 3-4 Benzpyrene (3-4 Benzpyrene changes to a liquid state when gas temperature is about 450° C. at 1 ata), and water vapor to become liquid. Liquids can be trapped far easier than gases in the porous ring-shaped intermediate filter 9.

d. Thus the combination of (a), (b) and (c) discussed above, (in a special case only the combination of (a) and (b) is employed hence the number of holes is zero) works together so effectively that after a smoker's first or second puff of a cigarette, that is in a time of several seconds after one begins to smoke, the trapping of the component substances in cigarette smoke, such as tars, nicotine, 3-4 Benzpyrene, and water by the intermediate filter 9 is much greater by 10–20 times as compared to that of a conventional cigarette filter tip and, therefore, the intermediate filter 9 converts itself automatically into a liquefied filter in the few seconds following the commencement of its use. This effect did not exist before. Conventional cigarette filter tips, however, remain in their original state, that is as dry porous filters and they become only slightly wet even after one finishes an entire cigarette.

Figure 9:
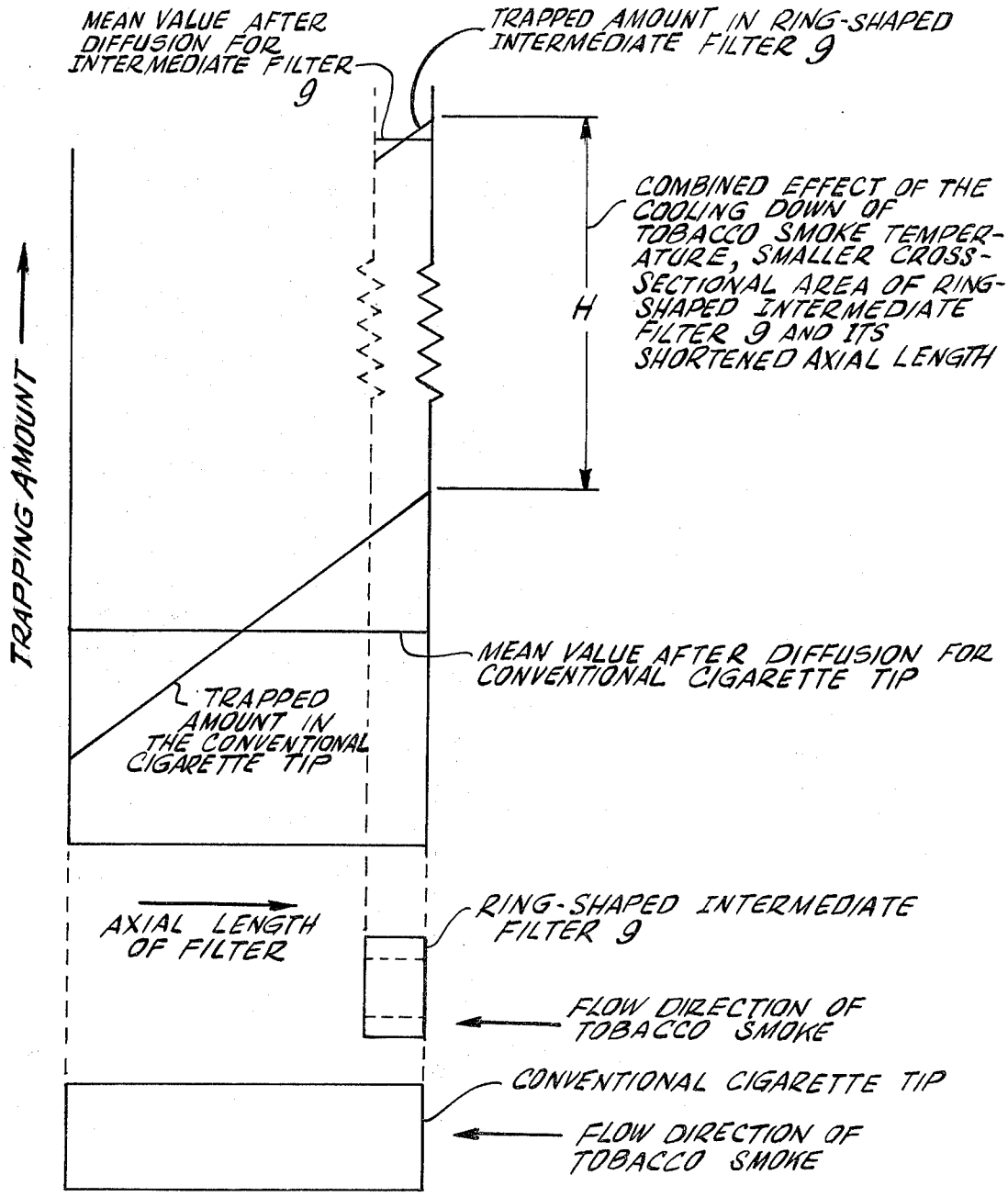
FIG. 9 graphically illustrates an actual example of the extraction of the component substances of tobacco smoke in the intermediate filter.

Therefore, in reality the total extraction of harmful component substances in tobacco smoke, like tars, nicotine, 3-4 Benzpyrene, and the like, in the intermediate filter 9, at a certain time after smoking has commenced, actually occurs as shown in FIG. 9.

In FIG. 9, the height H shows the combined effect of first, rapid cooling down of the smoke temperature by mixing it with outside cool air jets drawn into the chamber 4'', second, the narrowed cross-sectional area of the ring-shaped intermediate filter 9 which enhances the density of flowing smoke per unit area of the filter, and, finally, the shortened axial length of the intermediate filter 9 which helps to heighten the mean density value of trapped substances throughout the entire volume of the filter after the diffusion process. Passing a certain critical point, reached very rapidly with the help of the features (a), (b) and (c), the capability of the ring filter 9 increases exponentially.

Figure 4:
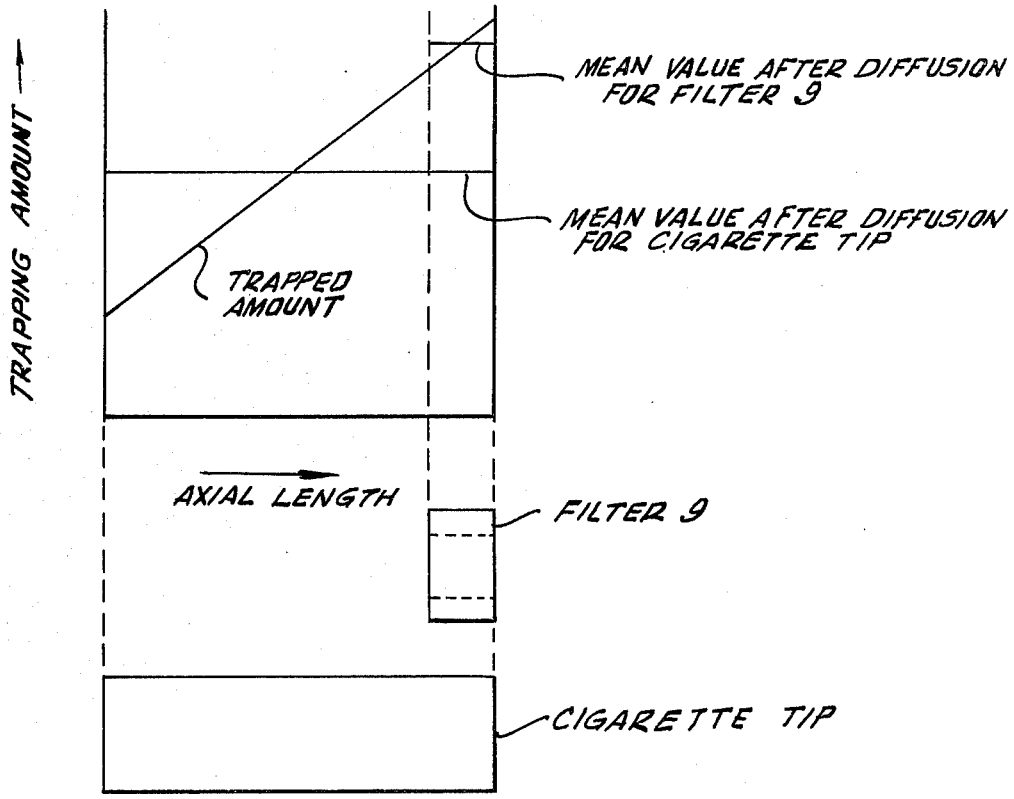
FIG. 4 illustrates the formation of the levels of mean density of harmful substances trapped in the intermediate filter of the present invention, and in a conventional cigarette filter tip, respectively, after uniform dispersion by diffusion throughout each filter, and in which linear trapping is assumed.

FIG. 4 explains the mechanism which affords a higher mean density value of trapped substances in the intermediate filter 9 as compared to that within a conventional cigarette tip owing to the shortened axial length of the said intermediate filter.

Figure 5:
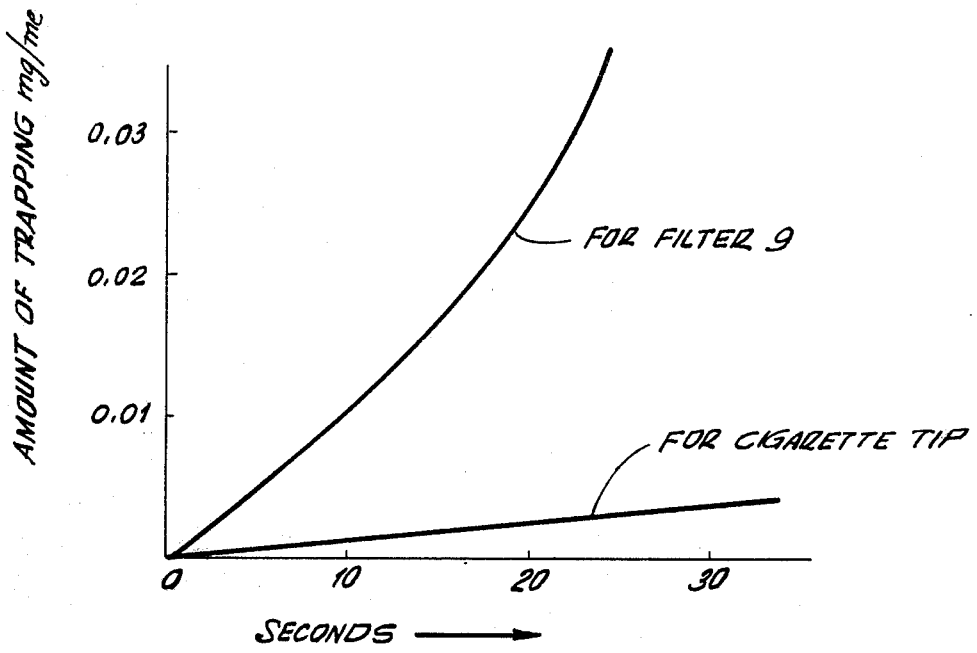
FIG. 5 graphically illustrates the effectiveness of the intermediate filter used in the present invention after becoming liquefied as compared to the effectiveness of a conventional cigarette filter tip showing the trapped amount (mg) per unit volume of filter (ml) against time (seconds) elapsed after one commences smoking at a certain rate.

Thus the ability of this liquefied intermediate filter 9 to trap harmful substances in the smoke becomes enormously enhanced as clearly indicated in FIG. 5, as a result of the rapid self-liquefication due to the above-described effect. This phenomenon of the intermediate filter 9 automatically changing to a liquid filter in a manner of a few seconds after smoking begins by virtue of a combined features of (a), (b) and (c) discussed above, is referred to as the "self liquefication of filter 9". It is important that this rapid liquefication of filter 9 is accomplished without supplying even a drop of water from outside. As soon as the filter 9 (turned-liquid filter) develops, it begins to act as a powerful second intermediate filter which did not exist before. As a result, harmful component substances like tars, nicotine, and 3-4 Benzpyrene, or water though it is not harmful, begin to catch themselves by themselves. This "snow-balling effect" is the exponential increase in FIG. 5 for filter 9. When impurities y [mg/ml] catch themselves, then $$dy = Adt + kydt \quad \text{(I)}$$

the solution is $$y = (A/K)(e^{kt} - 1) \quad \text{(II)}$$

wherein e=2.718, A(mg/ml/sec), and K(1/sec) are constants and t is time. In the equation A may be called "a surface contact exchange ability of a filter." In equation (II) y stands in fair agreement with the experimental results shown in FIG. 5. In FIG. 5, $K = 6.2 \times 10^{-2}$ and $A = 6.83 \times 10^{-4}$, respectively. Whereas conventional cigarette filter-tips remain unchanged during smoking except for a little discoloration, for such filter-tips:

$$dy = Adt \quad \text{(III)}$$

the solution is $$y = At \quad \text{(IV)}$$

The y in equation (IV) means the amount of trapping in a conventional cigarette filter-tip increases only linearly with the time t (FIG. 5).

The trapping ability of this intermediate filter 9 turned liquid filter is so great, as clearly indicated in FIG. 5, that, though the volume of intermediate filter 9 is quite small, the total catch of harmful substances can very easily be 2 or 3 times more than that for conventional cigarette filter tips. The total trapped amount "g" for a filter can be expressed by the equation (1)

$$g = \text{trapping ability} \times \text{volume of filter} \quad (1)$$

where, trapping ability=(amount of trapped substances in weight, at a certain velocity of smoke in a certain elapsed time interval after one begins to smoke/volume of filter).

The filter volume of the ring-shaped intermediate filter may be 1/20 of a conventional cigarette filter-tip but the trapping ability of the liquefied intermediate filter can easily be 40–60 times, or more, than that for conventional cigarette filter-tips as shown in FIG. 5, hence "g" can become 2 or 3 times more. When wood is used for the hit-stick 6, the liquefication of the ring-filter 9 becomes much more pronounced because wood will not easily absorb the liquid components in the smoke.

An important feature to be noted about the liquefied intermediate filter is that there is no loss of the taste of tobacco at all after the tobacco smoke passes through the liquid filter. This is due to the fact that all the tasteful substances contained in tobacco smoke are so volatile that they evaporate at a very low temperature. The axial length of the filter 9 of 1 or 3 mm, when optimized, also helps. Indeed the taste of a tobacco cannot change much after passing through such a short path of the filter. (=short path effect). On the contrary when one uses the filter of the present invention, tobacco smoke becomes more tasty because unpleasant tasting and unsavory substances like tars, extra nicotine, 3-4 Benzpyrene and the like in the cigarette smoke are so effectively removed and tasteful substances remain almost intact in the gaseous state in the cigarette smoke so the taste of a cigarette is that much more emphasized.

Figure 12A:
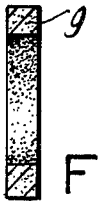
FIGS. 12*a*, 12*b* and 12*c* are a transverse sectional view, a side elevation view and a perspective view, respectively, showing the ring-shaped configuration of the intermediate filter of the present invention.
Figure 12B:
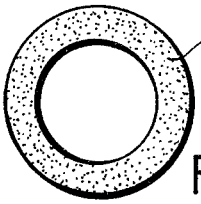
Figure 12C:
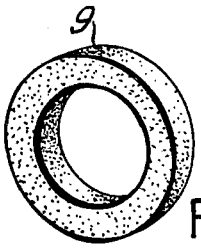
Figure 13:
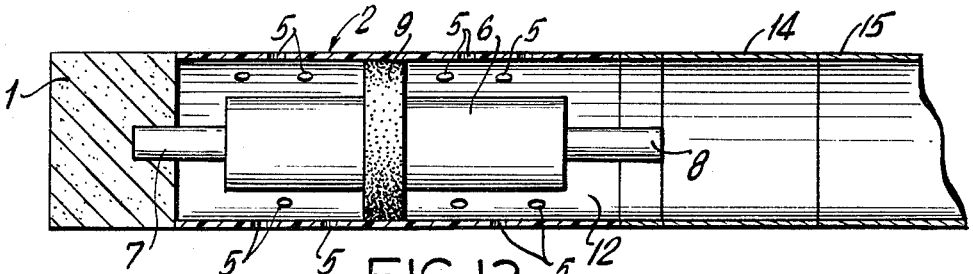
FIG. 13 shows one example of the filter of the present invention in its unused state.

The differences of the ring-filter 9 to be emphasized, note its complete ring-shape in FIGS. 12*a*, 12*b* and 12*c*, over conventional porous filters for cigarettes, are its small volume, due to its shortened axial length, its narrowed smoke passage ring-shaped cross-sectional area, the tremendous rapidity at which it is automatically transformed into a liquefied filter, and the distinctly new concept of "let the impurities catch themselves". In other words, the harmful substances begin to catch themselves by themselves in the intermediate filter 9. The small volume of the filter 9 is also important, because the filters of the present invention are mass-production articles. FIG. 9 illustrates the actual situation of catching the smoke components in the intermediate filter 9. In this illustration, the height "H" indicates the combined effect of both the tobacco smoke cooling by the air jets, and the narrowed ring-shaped intermediate filter 9 with its short axial length. FIG. 13 shows a snow-white hit-stick 6 and also snow-white ring-filter 9, in their unused state.

Figure 14:
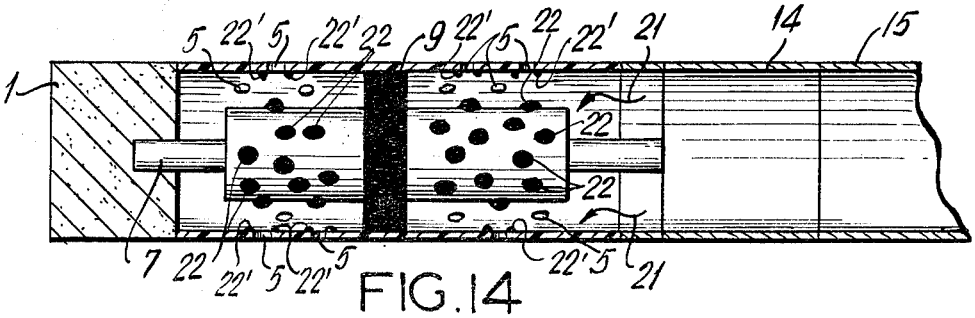
FIG. 14 illustrates the same filter as in FIG. 13, but after a part of a cigarette has been smoked.

FIG. 14 provides an excellent illustration of a completely liquefied ring-shaped filter 9, blackened with impurities, note the numerous black dots of impurities upon the surface of the hit-stick 6 and around the periphery of the holes 5, which collect only after smoking a part of a cigarette.

Figure 15:
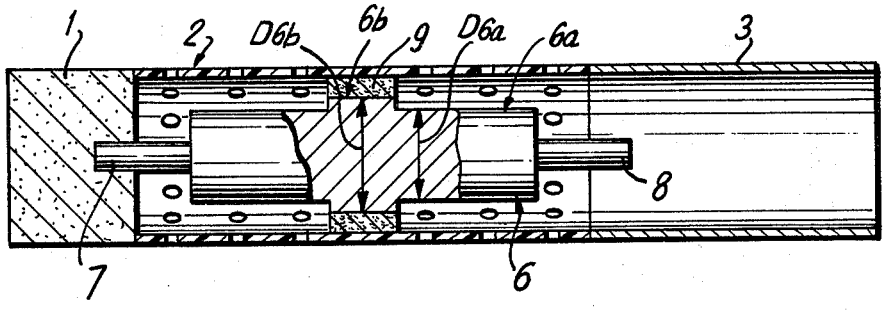
FIG. 15 is a side view, partly in section, illustrating another embodiment of the filter of the present invention.

FIG. 15 illustrates another embodiment of the filter of the present invention. This filter is basically the same as the one shown in FIG. 1, except for the hit-stick 6 which has two sections 6*a* and 6*b*. Section 6*b* located intermediate the ends of the hit-stick 6 and extending in the axial direction thereof, has a larger (sometimes a smaller) diameter D6b than the section 6*a*. Section 6*a* has a diameter D6a and extends axially from both ends of section 6*b*.

Intermediate ring-filter 9 encircles the section 6*b* for its axial length, it is in contact around its radially inner surface with the section 6*b* and around its radially outer surface with the inside surface of the body portion 2.

Figure 16A:
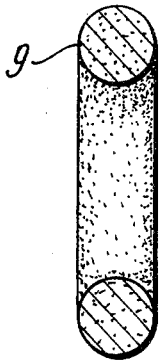
FIGS. 16*a*, 16*b* and 16*c* are a transverse sectional view, a side elevation view, and a perspective view, respectively, showing a delicious looking doughnut-ring-shaped configuration of the intermediate filter of the present invention.
Figure 16B:
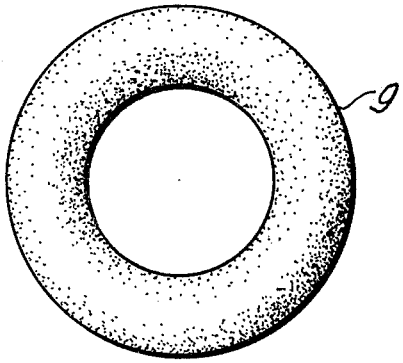
Figure 16C:
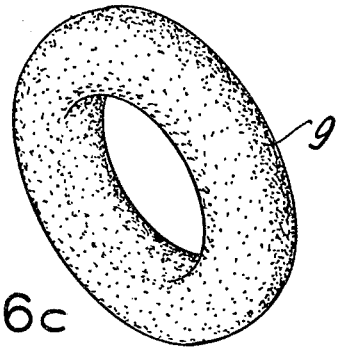
Figure 17:
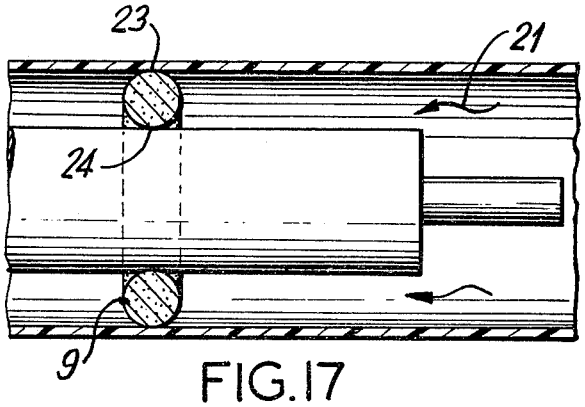
FIG. 17 shows one example of the filter of the present invention with a doughnut-ring filter in its unused state.
Figure 18:
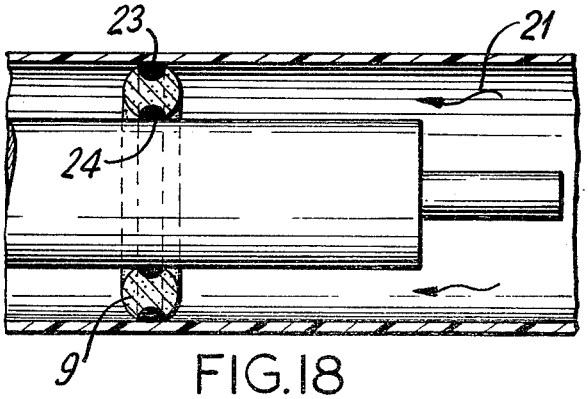
FIG. 18 illustrates the same filter as in FIG. 17, but after a cigarette has been smoked using the filter

By selectively varying the diameter of the section 6*b* and the complementary radial thickness of the intermediate filter 9, the functions of the "Air Jet Cooling and Hitting Extraction Effect" and the "Automatic Rapid Self-Liquefaction of the Intermediate Filter" can be controlled independently of one another. Optimization of these functions can be effected separately, since the diameters D6a and D6b can be selected apart from the other dimensions of the filter. If desired, the number of sections of the hit-stick having different diameters can be increased over that shown in FIG. 15. A delicious looking doughnut-ring filter as shown in FIGS. 16*a*, 16*b* and 16*c* for the intermediate filter 9 can effect more quick self-liquefication effect, because more smoke passes through contact points 23 and 24 in FIG. 17. For these points 23 and 24 have the smallest flow resistance. The result is black ring-line appears instantaneously around the outer and inner contact rings of the points 23 and 24 of the doughnut-ring filter as shown in FIG. 18 after smoking only a one suction of the tobacco smoke. This effect of quickening the self-liquefication of the intermediate ring filter 9 is more convincing to the eyes of the smoker and the quickened liquefication effect eliminates impurities faster and the smoker can enjoy much more delicious taste of the tobacco. The contact point 24 could be more flat.

Another function of the invention is referred to as "Negative Pressure Extraction". This is due to the fact that smoke entering the chamber part 4 expands adiabatically so that its temperature will drop. Hence, some of the component substances in the cigarette smoke are extracted by themselves.

Another function of the invention is "Filter Tip 1 Filtering". This needs no explanation as it is self-evident. It is to be here emphasized that the invention is capable of almost completely filtering out 3-4 Benzpyrene, the most dangerous cancer developing material in the human lung, which has been proved to be contained in tobacco smoke. 3-4 Benzpyrene changes from the gaseous to liquid state at about 450° C. under 1 ata. The present invention can cool down the temperature of smoke in the chamber part 4" to about 450° C. instantaneously and easily by cool violent air jets. Hence the liquefication of 3-4 Benzpyrene occurs instantly in the chamber part 4" and liquid 3-4 Benzpyrene is trapped far easier by the filter 9 and tip 1 than it would be in the gaseous state. Of course direct hitting of this substance against the solid wall of the hit-stick 6 can also eliminate this harmful substance to a considerable extent.

As a result of the foregoing described structure the present invention has the following characteristics.

Figure 6:
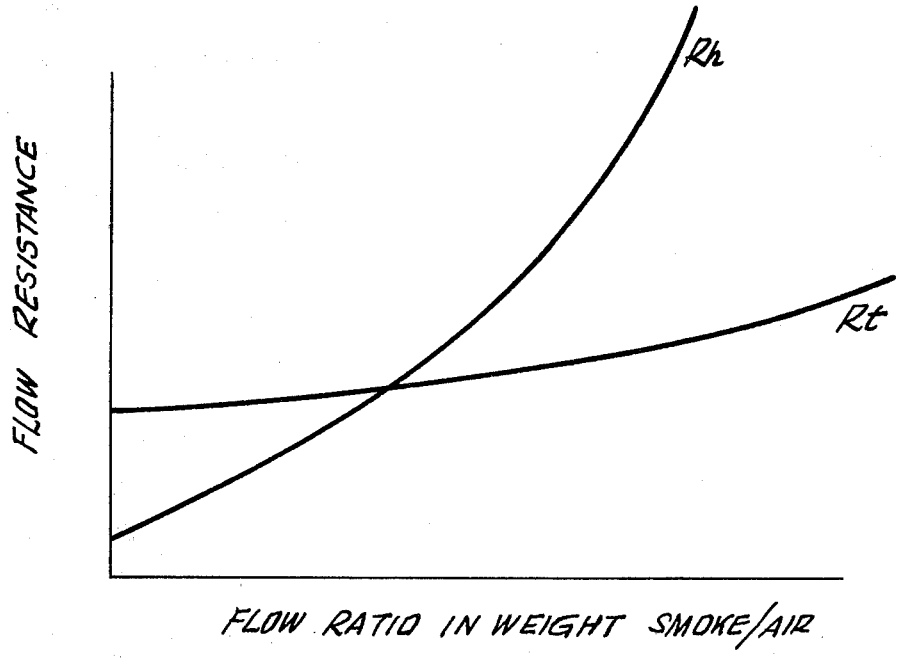
FIG. 6 graphically illustrates one example of fluid resistance curves for air admitted through the holes provided in the present invention (Rh) and tobacco flow resistance (Rt) against smoke/air weight ratio.

"Automatic smoke-air mixture rate control characteristic". The fluid resistance for the air jet that comes into the passage 12 through the holes 5 can be designed as Rh (as indicated in FIG. 6), for example, by carefully selecting the flow coefficient of the holes 5, since the holes 5 are of very small diameter and one can choose this diameter to be of any desired size by only adjusting the clearance of the passage 12 and the number of holes. Inherent tobacco smoking resistance may be expressed as Rt in FIG. 6. Accordingly, when a smoker draws weakly on a cigarette, then the smoke ratio in a smoke-air mixture is small since Rt is substantially large compared to Rh. When a smoker draws strongly then the smoke ratio becomes very great. Accordingly, a smoker can select his preferred smoke-air mixture ratio to the range he likes, almost automatically, without using any bothersome devices, by merely changing his suction strength.

This characteristic of the invention is very similar to that of smoking a cigarette without using the invention. When a person smokes conventional cigarettes without using this invention, if he draws weakly on the cigarette, smoke will be drawn in small amounts, if he draws strongly then smoke will be drawn in large amounts. Hence, when one uses this invention he feels almost like he is not using it at all from the standpoint of suction-resistance or suction difficulty.

In other words, a smoker does not feel the presence of this invention from the standpoint of its suction-resistance if he closes his eyes when he smokes, while the invention functions remarkably in eliminating harmful substances contained in tobacco smoke. Thus easy and pleasant smoking of a controlled mixture of air and tobacco smoke with remarkable extraction of harmful substances contained in the tobacco smoke is always assured by this invention in spite of its very simple structure without any bothersome control devices.

Another characteristic of the invention is "Dynamic load follow characteristic". $F_1$=Air jet cooling and hitting extraction effects; $F_2$="Automatic liquefication of intermediate filter effect"; and $F_3$="Negative pressure extraction effect". These are functions of air jet velocity $v_a$ and smoke velocity $v_s$, respectively, and they are all independent of each other. Each function tends to increase when the load increases (when $v_a$ and $v_s$ become large). The total extraction effect is the multiplied combination of all three of these.

Accordingly, the following can be qualitatively assumed. The effect of air jet hitting can be roughly proportional to $v_a$. When the difference of pressure between the outside air and in the chamber 4 is $\Delta$ p:

$$v_a \propto \sqrt{\Delta p} \quad (2)$$

and $$F_1 \propto v_a \quad (3)$$

The degree of automatic liquefication of filter 9 can be assumed to be proportional to the amount of smoke that comes in per unit time. Therefore, double the smoke then double the trapping of tar, water etc. hence double the liquefication aided by the cooling effect; then $$F_2 \propto v_s \quad (4)$$

$$\Delta p \propto v_a^2 \quad (5)$$

It should be realized that the following assumptions are approximate and for qualitative analysis. The greater is the negative pressure $\Delta p$, the more violent is the adiabatic change of the smoke, hence the greater is the temperature drop. When pressure p is constant in the process of an adiabatic change, $$d\,T = dp \quad (6)$$

$$\Delta T = \Delta p \quad (7)$$

here T denotes temperature. If we assume that extraction is proportional to temperature change T, then $$F_3 \propto \Delta T \propto v_a^2 \quad (8)$$

When we put total extraction as F, then $$F = F_1 \times F_2 \times F_3 \quad (9)$$

as $F_1$, $F_2$ and $F_3$ are all functions independent from one another, substituting (3), (4), and (8) into equation (9)

$$F \propto v_a \times v_s \times v_a^2 \quad (10)$$

If we approximate $$v_a \frac{1}{\tau} v_s = V \quad (11)$$

then $$F \propto v^4 \quad (12)$$

Velocity v may be interpreted as smoking velocity, that is, smoking intensity, hence representing the smoking load. Equation (12) shows that if the smoking load v increases, then the power for extracting harmful substances increases proportionally to the fourth power of that velocity v or smoking load. This is quite a load followability of the filter of this invention.

This analysis is, of course, approximate and the real extraction may be somewhat different. Especially equation (8) is a bit dubious. But if we dropped the function $F_3$ from equation (9), the equation (12) still becomes $F \propto v^2$, and the invention can still follow the load proportional to the square power of smoking velocity v (=load). This shows quite clearly how effectively and remarkably this invention can extract harmful substances from tobacco smoke when a person draws more strongly on a cigarette.

The foregoing is due to the fact that this invention has inherent dynamically changing variables such as $F_1$, $F_2$ and $F_3$, which increase their ability very rapidly and effectively as the load increases.

This dynamic load following is most advantageous in the protection of a smoker's health. While conventional cigarette filter tips, or any other porous filters have no such dynamic functioning variables and can only filter by surface contact exchange with smoke, then as the quantity of smoke increases, the greater is the passage of harmful substances. As a result, such conventional filters are effective only when a person draws lightly sucking in very little smoke and they are very ineffective when a person draws strongly offering little advantage to a smoker's health.

Conventional cigarette filter tips stay dry almost throughout the entire smoking process to its very end, only becoming slightly wet.

Therefore, with conventional filter tips, self-liquefaction of filter plays no role, that is, they have no $F_2$ function, no self-liquefaction of the filter.

Notice that the equation (4) will not hold water except when a filter becomes sufficiently and very quickly liquefied with the help of the cold air-jet cooling effect on the smoke temperature, enhanced smoke flow density, and so on. Of course conventional cigarette tips have no $F_1$ function and also no $F_3$ function. So, in case of a conventional cigarette tip no increase of trapping capabilities occurs as the load increase, therefore, no load-followability is present as in the present invention.

Another characteristic of the invention is the "Tobacco burning temperature drop". Because this invention provides the air jet effect, smokers who use it are forced to smoke cigarettes slowly to some degree, though unknowingly, whether they like it or not. This helps the cigarette to burn slowly and more cooling of the cigarette fire is effected by the surrounding air. The combined effect of slow burning and of the supply of more cooling air can cause the burning temperature of the cigarette to drop to 600°–700° C. compared to that of the conventional cigarette smoking temperatures of more than 900° C. It is reported that harmful substances produced in tobacco smoke can be reduced drastically when the smoking temperature is reduced.

Another characteristic is "Taste controllability". The above-mentioned air jet effect $F_1$, liquid filtering effect $F_2$, and negative pressure extraction effect $F_3$, each extract somewhat different substances from the others so a good combination of the above three functions $F_1$ $F_2$ and $F_3$ can control tobacco taste to a certain degree.

Accordingly, it will be appreciated that the filter embodying the present invention can provide the following advantages:

1. It makes smoking very easy and comfortable due to the air jet effect, whereby a smoker feels little suction resistance. This also makes the cigarette taste more mild, sweet and cool. Theoretically, the filter of the present invention can eliminate all the impurities in tobacco smoke without any increase in suction resistance. Consider the effect if the number of holes could be increased to infinity.

2. A variety of filtering effects can be produced by only changing the number of holes.

3. The filter requires almost no structural strength.

4. The filter requires dimensional tolerances in the order of only 1/10–1/100 mm.

5. The filter can be made of almost any material, using only very small amounts.

6. The filter is easily produced because of its simple construction.

7. The filter has a very low cost.

8. The filter can be disposed of after use with 1–3 cigarettes, since it is very low-priced. Therefore, it is always fresh, it needs no cleaning and a smoker's hand does not become dirty, it is very light and easy to handle, and a smoker can enjoy the best taste fresh and easy with each new cigarette.

9. The filter can have an elegant styling.

10. The exterior of the filter can be designed with printing only, whereby its design can be changed with no appreciable cost increase. Paper is particularly useful for the cigarette holding part 3 since it is easier to print on paper as well as on soft thin plastics rather than on wood, metal or hard plastics.

11. When made with a transparent body, the filter has a "See-Through Look-Style Structure" which can provide tremendously big enjoyment in being able to see the inner structure, the process of "Air-Jet Cooling and Hitting Extraction", and the "Automatic Liquefication of Intermediate Filter". The hollow cylindrical body portion 2 can be made transparent using materials such as cellophane. The material strength of cellophane is quite sufficient to support the hollow cylindrical body portion.

12. By using the filter of the present invention a smoker can enjoy cigarette and/or tobacco safely and tastefully to its very end, because of the above-mentioned dynamic load follow, the smoke cooling by air jet, and the cigarette does not actually become hot until its very end.

13. The effect of this filter can be easily varied by placing a finger on the hollow cylindrical body portion to close some of the holes 5 according to the smoker's likings.

14. The filter can be made chic and elegant in style so as to be suited not only for men but also for women. The protection of a woman smoker's health against tobacco smoke hazards is especially important when she is pregnant.

While the invention has been described and illustrated with respect to certain embodiments which give satisfactory results, it will be understood by those skilled in the art, after understanding the purpose of the invention, that various other changes and modifications may be made without departing from the spirit and scope of the invention, e.g., the same principles in the foregoing pages can be useful for the prevention of an environmental pollution and/or for enhancing heat transfer characteristics of a heat exchanger and so on, in this case, the black dot is heat itself, and it is only necessary to make another axial passage for a fluid flow through said hit-stick 6, and it is therefore intended to cover all such changes and modifications in the appended claims.

What is claimed is:

1. A filter for tobacco smoke comprising an axially extending hollow body portion, a porous filter tip coaxially carried at one end of said hollow body and intended to be placed into the mouth of a smoker, a cigarette holding part coaxially connected with the other end of said hollow body for receiving and holding a cigarette to be smoked, said cigarette holding part is cylindrically shaped having an inside diameter approximately equal to the outside diameter of a cigarette to be inserted thereinto, said cigarette holding part having an open end for receiving one end of the cigarette, a solid impermeable hit-stick coaxially positioned within said body portion and having an axial length extending for at least a major portion of the axial length of said body portion and an outer diameter less than the inside diameter of said hollow body portion thereby forming a ring-like passage between the inside wall surface of said body portion and the outer surface of said hit-stick, a support projection coaxially extending from one end of said hit-stick and firmly attached to the central part of said porous filter tip, a porous intermediate filter having a shape substantially the same as said ring-like passage and positioned between the ends of said hit-stick, the radially inner wall of said intermediate filter tightly surrounding said hit-stick and the radially outer wall thereof tightly abutting against the inside wall surface of said hollow body portion thereby extending transversely across the entire said ring-like passage and dividing said ring-like passage into first and second interior chambers located adjacent the filter tip side and the cigarette holding part side respectively, and a plurality of nozzle holes formed in the wall of said hollow body portion and extending into said first and second chambers providing means for drawing cool outside air into said ring-like passage in violent jets to engage cigarette smoke passing therethrough for extracting impurities therefrom.

2. A tobacco smoke filter according to claim 1, wherein said hollow cylindrical body portion is made of one of transparent and semi-transparent material.

3. A tobacco smoke filter according to claim 2, wherein said transparent material is cellophane.

4. A tobacco smoke filter according to claim 1, wherein said hollow cylindrical body portion is made of opaque material.

5. A tobacco smoke filter according to claim 1, further comprising a stopper coaxially extending from the other end of said hit-stick to act as a stopper preventing excessive insertion of a cigarette into said cigarette holding part.

6. A tobacco smoke filter according to claim 1, wherein said plurality of holes are in the range of 10 to 200 and are distributed about the periphery of said hollow body portion and are located radially opposite said hit-stick.

7. A tobacco smoke filter according to claim 6, wherein the axes of said holes extend perpendicularly to the longitudinal axis of said hit-stick.

8. A tobacco smoke filter according to claim 6, wherein the axes of said holes extend at an oblique angle to the surface of said hit-stick.

9. A tobacco filter according to claim 6, wherein said holes in said body portion have a diameter in the range of 0.01–0.5 mm are spaced apart at approximately 0.1 mm–5 mm.

10. A tobacco smoke filter according to claim 1, wherein said hit-stick is made of wood.

11. A tobacco smoke filter according to claim 1, wherein the cross-sectional shape of said body portion and said hit-stick are complementary forming a passage therebetween which is complementary therewith, the distance between said hit-stick and the inner wall of said body portion being in the range of 0.01 mm to 2.0 mm.

12. A tobacco smoke filter according to claim 11, wherein said hollow body portion and said hit-stick are each cylindrical so that said passage therebetween has a circular ring-shape.

13. A tobacco smoke filter according to claim 1, further comprising a thin, soft and elastic inner layer covering a major axially extending portion of the inner wall surface of said cigarette holding part which is formed of a relatively thick, strong and resilient material and the adjacent end of said inner layer being displaced slightly inwardly from the open end thereof.

14. A tobacco smoke filter according to claim 13, wherein said cigarette holding part and said inner layer are made of a waterproof material.

15. A tobacco smoke filter according to claim 13, wherein said inner layer is secured to said cigarette holding part so that there is no relative displacement therebetween.

16. A tobacco smoke filter according to claims 1 and 13, wherein said cigarette holding part is made of hard plastics of the thickness of 0.0001 mm and 0.5 mm.

17. A tobacco smoke filter according to claim 16, wherein said tobacco holding part is made of one of transparent materials and semi-transparent materials.

18. A tobacco smoke filter according to claims 1 and 13, wherein said inner layer is made of one of paper and plastics of the thickness of 0.0001 mm and 0.5 mm.

19. A tobacco smoke filter according to claims 1 and 13, wherein said inner layer is made of one of transparent and semi-transparent materials.

20. A tobacco smoke filter according to claim 1, further comprising a plurality of intermediate porous filters axially spaced from each other and positioned along the axial length of said hit-stick.

21. A tobacco smoke filter according to claim 1, wherein said hit-stick is made of a paper-clad material.

22. A tobacco smoke filter according to claim 1, wherein said hit-stick is made of one of plastics and metals which has undergone a surface treatment.

23. A tobacco smoke filter according to claim 1, wherein said cigarette holding part is made of one of paper and a soft plastics having a thickness of 0.0001 mm–0.5 mm and the material of said cigarette holding part being light, compact and easy to print on, and the filter can be used and disposed of as desired.

24. A tobacco smoke filter according to claim 1, wherein said hollow cylindrical body portion is made of a waterproof material.

25. A tobacco smoke filter according to claim 1, wherein said hit-stick is cylindrically shaped and has at least two axially extending concentric sections each having a different diameter.

26. A tobacco smoke filter according to claim 25, wherein said hit-stick has a first axially extending section, a second axially extending section connected to and extending axially from said first section, and a third axially extending section connected to and extending axially from the end of said second section opposite the end connected to said first section, said first and third sections having the same diameter and said second section having a larger diameter than said first and third sections, said intermediate filter located on and extending around said second section of said hit-stick.

27. A tobacco smoke filter according to claim 1, wherein said hollow cylindrical body portion is made of one of paper and plastics of the thickness of 0.0001 mm and 0.5 mm.

28. A tobacco smoke filter according to claim 1, wherein said filter tip is made of one of transparent materials and semi-transparent materials.

29. A tobacco smoke filter according to claim 1, wherein said tobacco holding part is made of one of transparent materials and semi-transparent materials.

30. A tobacco smoke filter comprising an axially elongated hollow cylindrical body, a solid impermeable body coaxially positioned within said hollow cylindrical body with the outer surface of said solid body spaced inwardly from the inner surface of said hollow body and forming therebetween a ring-shaped smoke passage within said hollow body, said passageway having a cross-sectional area which is less than the cross-sectional area of a conventional cigarette filter tip, an annular porous filter element positioned within and filling the entire transverse cross-sectional area of said ring-shaped passageway and encircling said solid impermeable body whereby the amount of smoke passing through said porous filter element per unit of cross-sectional area and per unit of time is larger than that for the conventional cigarette filter tip, said porous filter element having an axial length less than 15 mm which is the length of conventional cigarette filter tips whereby the volume of said porous filter element is less than the volume of conventional filter tips and because of the shorter length the mean density of a given amount of impurities trapped inside said porous filter element is higher than a comparable amount of that within a conventional filter tip after diffusion, a plurality of holes formed in said hollow cylindrical body opening into said ring-shaped passage and said holes located along the axial length of said hollow body on both sides of said porous filter element, whereby ambient air drawn through the holes into said ring-shaped passage produces air jets which violently engage tobacco smoke within said ring-shaped passage before it passes through said porous filter element causing the temperature of the air-smoke mixture to instantaneously cool down to a point where a portion of the component substances of the tobacco smoke including tars, nicotine and water vapor reach their dew points and liquefy, enabling the liquefied components to be trapped easier within said porous filter element than when they are in the gaseous state.

31. A tobacco smoke filter according to claim 30, wherein said annular porous filter has a complete ring-form, its axial length ranging between 0.1 mm to 5.0 mm and its radial thickness ranging between 0.1 mm and 3.0 mm.

32. A tobacco smoke filter according to claims 1 and 30, wherein said annular porous filter has a doughnut-ring shape, its doughnut-like body section having a diameter ranging between 0.1 mm and 3.0 mm.

33. A method of extracting undesirable impurities from tobacco smoke comprising the steps of passing the tobacco smoke through an annularly shaped passageway in the axial direction thereof, arranging a solid impermeable hit-stick forming the inner surface of the annularly shaped passageway so that the smoke passing through the passageway flows axially therethrough over the surface of the solid impermeable hit-stick and arranging the surface of the hit-stick to provide optimum deposition thereon, drawing ambient air into the passageway in the direction extending transversely of the axial direction thereof for forming violent jets of air through a plurality of holes in the outside wall of the passageway and adjusting the number, shape and size of the holes to provide jets of air for striking the smoke in an effective and powerful manner and directing the jets of air inwardly toward the surface of the solid impermeable hit-stick, hitting the smoke in the passageway with the jets of air and depositing impurities in the smoke on the surface of the solid impermeable hit-stick so that the impurities deposit on the surface in the form of clearly visible black colored dots.

34. A method according to claim 33, including the step of cooling the smoke in the passageway by means of the jets of air drawn thereinto.

35. A method according to claim 33, including depositing impurities as clearly visible black dots forming rings around the periphery of the holes on the radially outer surface of the passageway by deflecting the jets of air from the surface of the solid impermeable hit-stick transversely across the passageway to the radially outer surface thereof.

36. A method of filtering impurities out of a gaseous substance comprising the steps of forming an axially extending passageway, positioning a solid impermeable member coaxially within said passageway with the outer surface thereof radially inward of the outer surface of the passageway so that the passageway is annular in shape, flowing a gaseous substance containing gaseous impurities axially through the annular passageway, introducing jets of air flowing into the annular passageway transversely of the axial direction thereof for violent mixing with the gaseous substance, cooling the gaseous substance with the air so that at least certain of the gaseous impurities liquefy, depositing impurities from the gaseous substance on the surface of the solid impermeable member, flowing the liquefied impurities and the air-gaseous substance through a dry filter substance which completely fills the annular passageway for liquefying the filter substance whereby the ability of the filter increases exponentially owing to the presence of the trapped liquefied impurities in the filter.

37. A method of extracting undesirable impurities from tobacco smoke comprising the steps of passing the tobacco smoke through an annularly shaped passageway in the axial direction thereof, arranging a solid impermeable hit-stick forming the inner surface of the annularly shaped passageway so that the smoke passing through the passageway flows axially therethrough over the surface of the solid impermeable hit-stick and arranging the surface of the hit-stick to provide optimum deposition thereon, drawing ambient air into the passageway in the direction extending obliquely of the axial direction thereof for forming jets of air through a plurality of holes in the outside wall of the passageway and adjusting the number, shape and size of the holes to provide jets of air for striking the smoke in an effective and powerful manner and directing the jets of air inwardly toward the surface of the solid impermeable hit-stick for striking the surface of the hit-stick obliquely of the axial direction thereof, hitting the smoke in the passageway with the jets of air and depositing impurities in the smoke on the surface of the solid impermable hit-stick so that the impurities deposit on the surface in the form of clearly visible black colored dots.

* * * * *